US006839944B1

(12) United States Patent
Liu

(10) Patent No.: US 6,839,944 B1
(45) Date of Patent: Jan. 11, 2005

(54) SHOELACE FASTENER

(75) Inventor: Kun-Chung Liu, No. 5, Alley 9, Lane 212, San-Feng Rd., Hou-Li Hsiang, Taichung Hsien (TW)

(73) Assignee: Kun-Chung Liu, Taichung Hsien (TW)

( * ) Notice: Subject to any disclaimer, the term of this patent is extended or adjusted under 35 U.S.C. 154(b) by 0 days.

(21) Appl. No.: 10/626,131

(22) Filed: Jul. 23, 2003

(51) Int. Cl.[7] ..... A43C 1/00; A43C 7/04; F16G 11/00

(52) U.S. Cl. ..... 24/712.1; 712/712.4; 712/712.6; 712/115 G; 36/50.1

(58) Field of Search ..... 24/712.5, 712.1, 24/712.2, 712.3, 712.4, 713, 713.3, 713.6, 714, 714.6, 712.6, 712.7, 115 G, 115 M; 36/50.1

(56) References Cited

U.S. PATENT DOCUMENTS 3,701,572 A * 10/1972 Velasquez ..... 24/712.4
4,817,250 A * 4/1989 Kurosaki ..... 24/115 G
5,097,573 A * 3/1992 Gimeno ..... 24/712.6
5,293,675 A * 3/1994 Shai ..... 24/712.1
5,903,959 A * 5/1999 Leonardi ..... 24/712.1
6,003,214 A * 12/1999 Lee ..... 24/712.1
6,094,787 A * 8/2000 Chang ..... 24/712.6
6,571,438 B2 * 6/2003 Liu ..... 24/712.2

* cited by examiner

*Primary Examiner*—Victor Sakran
(74) *Attorney, Agent, or Firm*—Merchant & Gould P.C.

(57) ABSTRACT

A shoelace fastener is provided for a shoe that includes a shoelace having a pair of distal lace segments. The shoelace fastener includes a substantially rigid fastener body formed with a pair of lace exit holes, a pair of lace entry holes disposed between the lace exit holes, and a pair of anchor portions, each of which is disposed between a respective adjacent pair of the lace entry and exit holes. Each of the distal lace segments is extendable through a respective lace entry hole, over a respective anchor portion, and into a respective lace exit hole. Tension applied by the shoe on the shoelace enables forces the distal lace segments against the fastener body. Pulling of the fastener body through a flexible pull unit on the fastener body results in loosening of the shoe.

9 Claims, 7 Drawing Sheets

SHOELACE FASTENER

BACKGROUND OF THE INVENTION

1. Field of the Invention

The invention relates to a shoe accessory, more particularly to a shoelace fastener for maintaining a tightened state of a shoe.

2. Description of the Related Art

In U.S. Pat. No. 6,571,438, there is disclosed a double-bow shoelace device that is adapted to be mounted on a shoe and that includes a shoelace, a clamp member, and an assembly of two loops and a decorative knot. The shoelace has a first lace segment that is strung on the shoe, and a second lace segment that includes first and second lace portions, each of which has a lower end connected to the first lace segment. The clamp member is sleeved slidably on at least one of the lace portions, and includes an elongate casing, a clamping block slidably received in the casing, and a biasing member disposed in the casing for biasing the clamping block to a lace clamping position. Downward and upward movements of the clamp member along at least one of the lace portions result in tightening and loosening of the shoe. The assembly is disposed on and externally of the clamp member.

Although the aforesaid shoelace device serves the purpose of tightening and loosening of the shoe, there are some drawbacks associated therewith. Particularly, because the clamping block of the clamp member must be forced inwardly into the casing against the biasing action of the biasing member when it is desired to loosen the shoe, the overall size of the clamp member must be large enough for the fingers of the user to press the clamping block and the clamp member toward each other. The relatively large clamp member has an adverse affect on the appearance of the shoe. It is also noted that the assembly of the loops and the knot on the clamp member is merely for decorative purposes, and does not have any practical function associated therewith.

FIG. 1 illustrates another conventional shoelace fastener 3 for a shoelace 4 having a pair of distal lace portions 402. The fastener 3 includes a plate body formed with an inner pair of lace entry holes 301 and an outer pair of lace exit holes 302. Two resilient clamp members 303 extend integrally from the plate body into the lace exit holes 302, respectively. In use, the distal lace portions 402 are first extended through the lace entry holes 301 and are subsequently extended through the lace exit holes 302. The clamp members 303 clamp the distal lace portions 402 against the plate body of the fastener 3. Although the aforesaid shoelace fastener 3 also serves the purpose of tightening and loosening of a shoe (not shown), there are still some drawbacks associated therewith. Particularly, since the fastener 3 must be pulled upwardly when it is desired to loosen the shoe, the lack of a pull component on the fastener 3 makes it difficult to conduct the pulling operation. Moreover, the size of the fastener 3 must be relatively large in order to facilitate upward pulling of the same.

SUMMARY OF THE INVENTION

Therefore, the object of the present invention is to provide a shoelace fastener that can overcome the aforesaid drawbacks associated with the prior art.

According to the present invention, there is provided a shoelace fastener for a shoe that includes a shoe body with a pair of eyelet tabs, and a shoelace strung on the eyelet tabs and having a pair of distal lace segments. The shoelace fastener comprises a substantially rigid fastener body and a flexible pull unit, secured on the fastener body.

The fastener body is formed with a pair of lace exit holes that are spaced apart from each other in a first direction, a pair of lace entry holes that are disposed between the lace exit holes and that are spaced apart from each other in the first direction, and a pair of anchor portions, each of which is disposed between a respective adjacent pair of the lace entry and exit holes and extends in a second direction transverse to the first direction.

In use, each of the distal lace segments is extendable through a respective one of the lace entry holes, over a respective one of the anchor portions, and into a respective one of the lace exit holes. Tension applied by the eyelet tabs upon the shoelace forces the distal lace segments against the fastener body for maintaining a tightened state of the shoe. A manual pulling force applied on the fastener body through the pull unit permits sliding movement of at least one of the distal lace segments for loosening the shoe accordingly.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
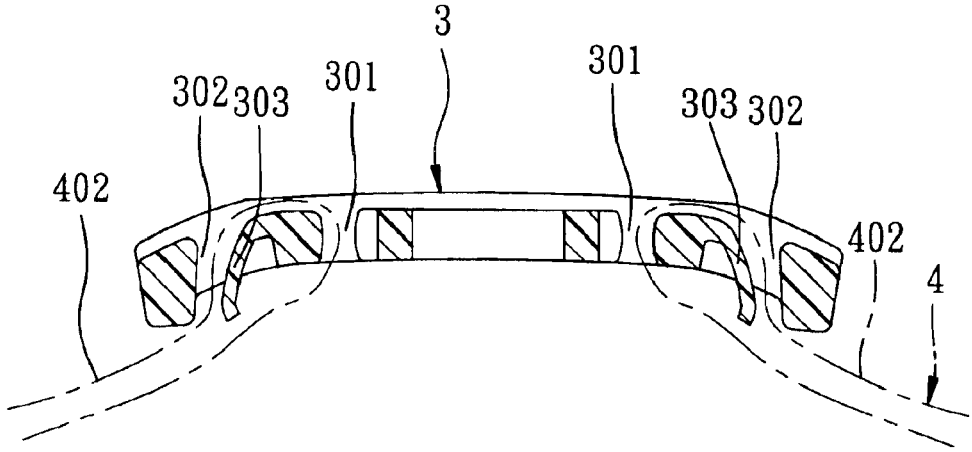
FIG. 1 PRIOR ART
FIG. 1 is a sectional view of a conventional shoelace fastener.
Figure 2:
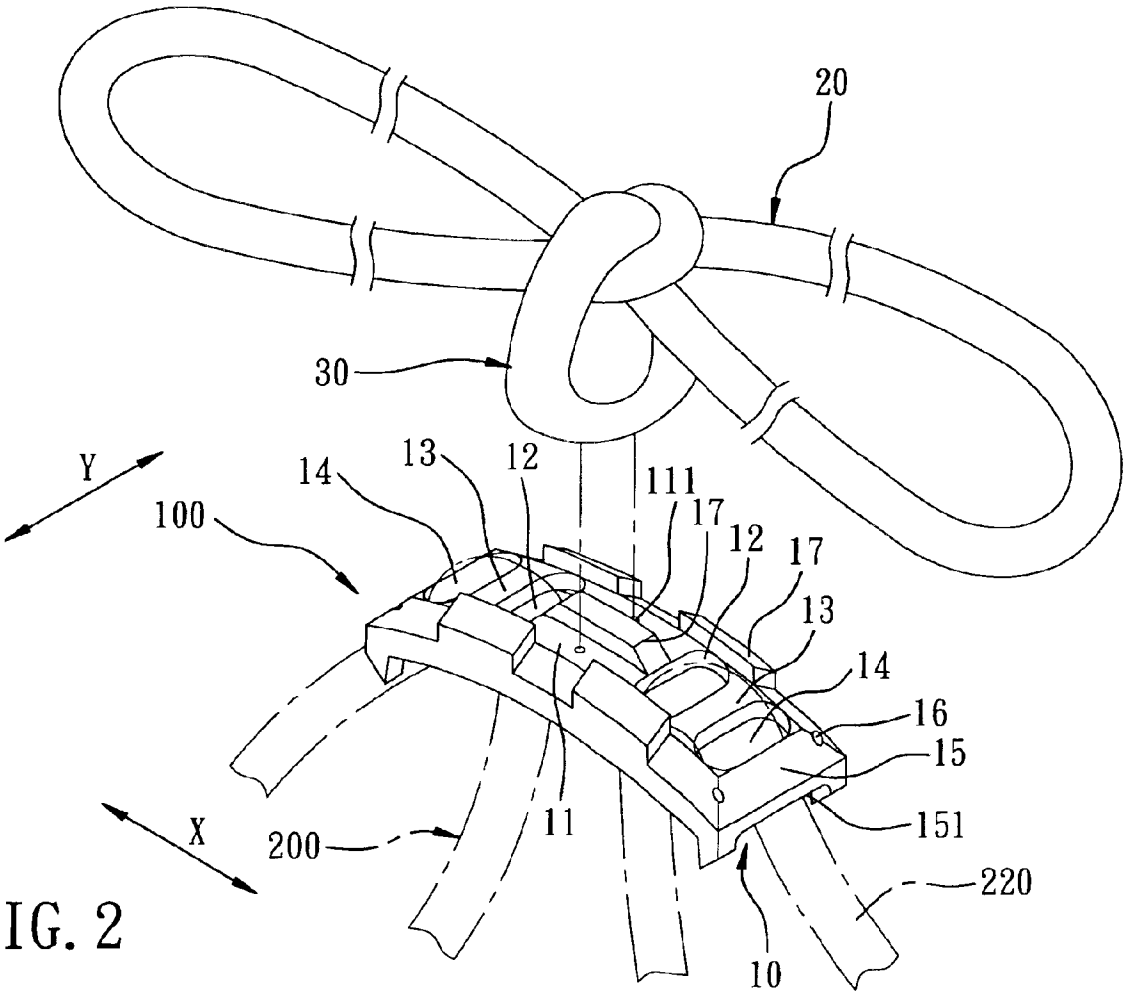
FIG. 2 is an exploded perspective view of the first preferred embodiment of a shoelace fastener according to the present invention.

Referring to FIGS. 2 to 5, the first preferred embodiment of a shoelace fastener 100 according to the present invention is shown to be adapted for use with a shoe that includes a shoe body 300 with a pair of eyelet tabs 310, and a shoelace 200 having an anchoring segment 210 strung on the eyelet tabs 310, and a pair of distal lace segments 220, each of which is connected to the anchoring segment 210 at one end. The shoelace fastener 100 includes a substantially rigid fastener body 10 and a flexible pull unit 20. It should be noted herein that, except for FIG. 5, the shoelace fastener 100 is not drawn to scale in the accompanying drawings and is actually illustrated in a magnified form for the sake of clarity.

In this embodiment, the fastener body 10 is an integrally formed convex plate made from plastic, such as by injection molding. The fastener body 10 is formed with a pair of lace exit holes 14 that are spaced apart from each other in a first direction (X), a pair of lace entry holes 12 that are disposed between the lace exit holes 14 and that are similarly spaced apart from each other in the first direction (X), and a pair of anchor portions 13, each of which is disposed between a respective adjacent pair of the lace entry and exit holes 12, 14 and extends in a second direction (Y) transverse to the first direction (X). The fastener body 10 has top and bottom sides, and the lace entry and exit holes 12, 14 are formed through the top and bottom sides of the fastener body 10. The fastener body 10 further has a mounting portion 11 between the lace entry holes 12, and a pair of lateral end portions 15 opposite to each other in the first direction (X). In this embodiment, the mounting portion 11 is formed with a pair of string holes 111 that extend through the top and bottom sides of the fastener body 10. Each of the lateral end portions 15 is formed with a lace notch 151 that extends from the bottom side of the fastener body 10 and that is in spatial communication with a respective one of the lace exit holes 14. Preferably, each of the lateral end portions 15 is similarly formed with a pair of string holes 16 that extend through the top and bottom sides of the fastener body 10. The top side of the fastener body 10 is further formed with a plurality of reinforcing, ribs 17, each of which extends in the first direction (X), for strengthening the overall construction of the fastener body 10. In use, a middle plane (L) of the fastener body 10, which is parallel to the second direction (Y), is disposed between the eyelet tabs 310 of the shoe body 300, as best shown in FIG. 5.

The pull unit 20 of this embodiment has two loop portions connected to a retaining band 30, and is secured to the top side of the fastener body 10. The pull unit 20 and the retaining band 30 are preferably made of the same material as the shoelace 200, and cooperate with the distal lace segments 220 of the shoelace 200 to form a double-bow configuration. The retaining band 30 is disposed around the fastener body 10 at the mounting portion 11. Each of a plurality of connecting strings 18 is disposed in a respective string hole 111, 16., and has one end connected to the pull unit 20, and an opposite end anchored to the bottom side of the fastener body 10, such as by tying said opposite end into a knot. Since the pull unit 20 is secured to the fastener body 10 at the mounting portion 11 and the lateral end portions 15, the number of pull points on the fastener body 10 to be acted upon by the pull unit 20 is increased.

Figure 3:
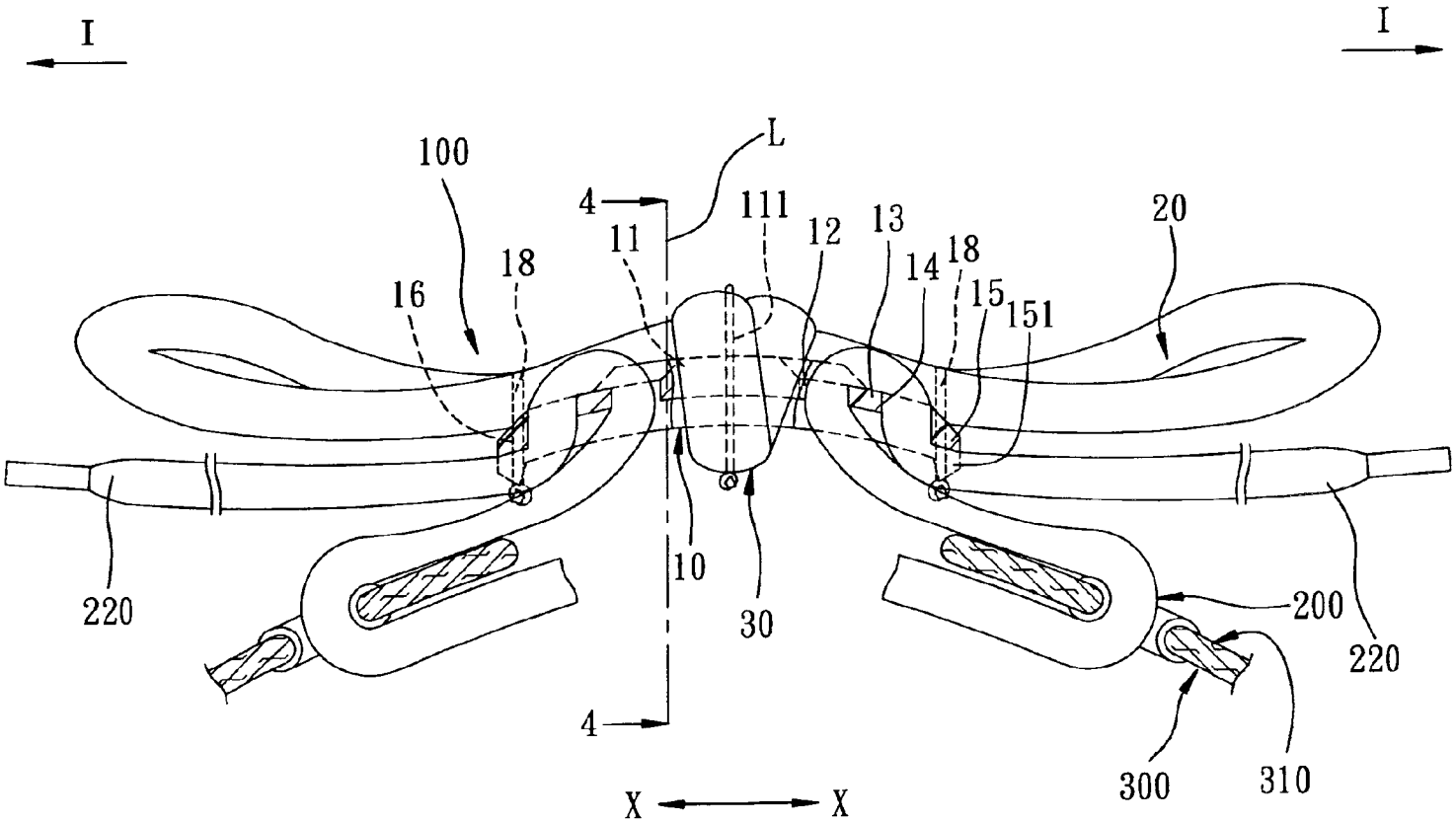
FIG. 3 is a schematic assembled sectional view of the first preferred embodiment to illustrate a tightening operation of a shoe that incorporates the first preferred embodiment.
Figure 4:
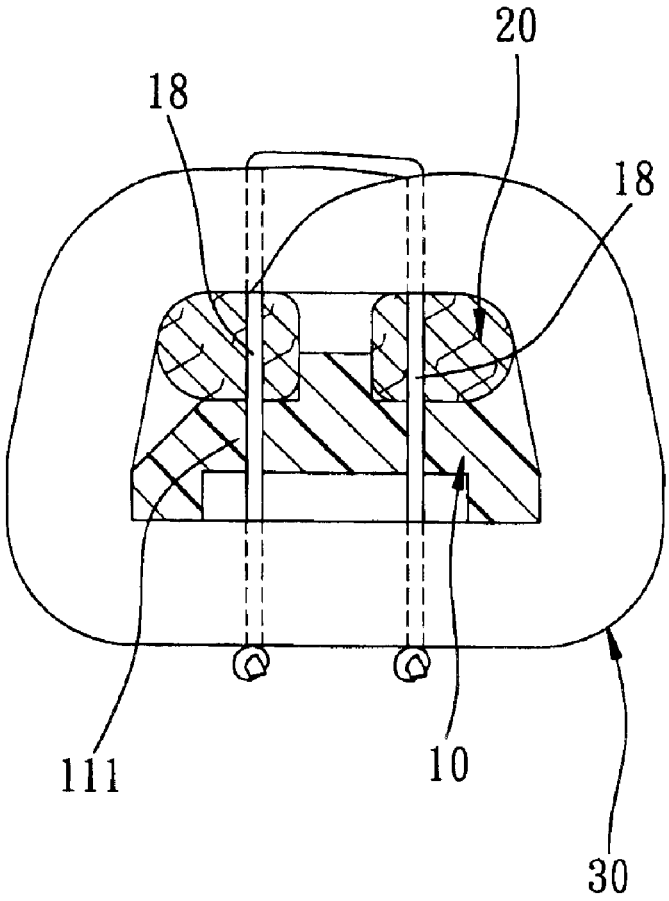
FIG. 4 is a sectional view of the first preferred embodiment, taken along lines 4—4 in FIG. 3.
Figure 5:
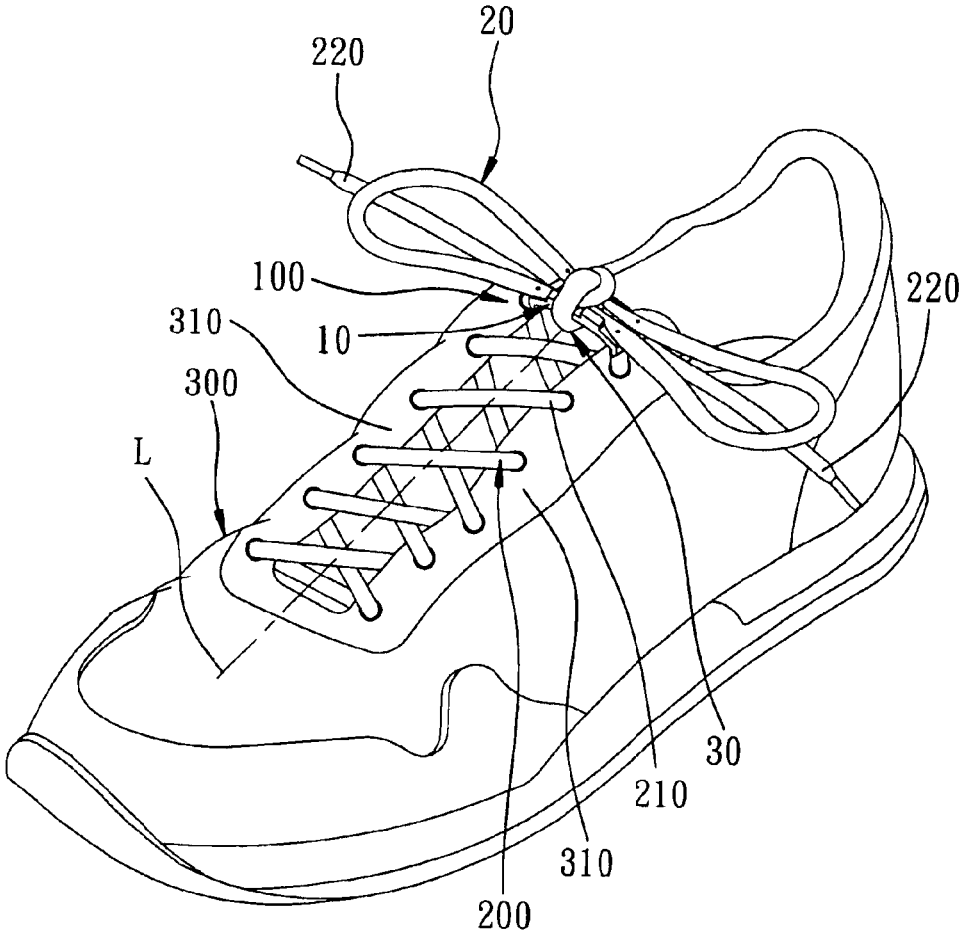
FIG. 5 is a perspective view showing a shoe that incorporates the first preferred embodiment of this invention.

As shown in FIGS. 3 and 5, in use, each of the distal lace segments 220 is extended through a respective one of the lace entry holes 12, over a respective one of anchor portions 13, into a respective one of the lace exit holes 14, and out of a respective one of the lace notches 151. At this time, the pull unit 20, the retaining band 30 and the distal lace segments 220 cooperate to form a double-bow configuration. After a foot (not shown) is slipped into the shoe body 300, the distal lace segments 220 can be pulled apart from each other as indicated by the arrows (I) in FIG. 3 to tighten the shoe body 300. When the shoe body 300 is tightened, the eyelet tabs 310 are forced apart by the foot in the shoe body 300, thereby applying tension on the shoelace 200. At this time, the distal lace segments 220 are clamped between the eyelet tabs 310 and upper edges of the lace notches 151 in the fastener body 10, thereby maintaining the tightened state of the shoe body 300.

Figure 6:
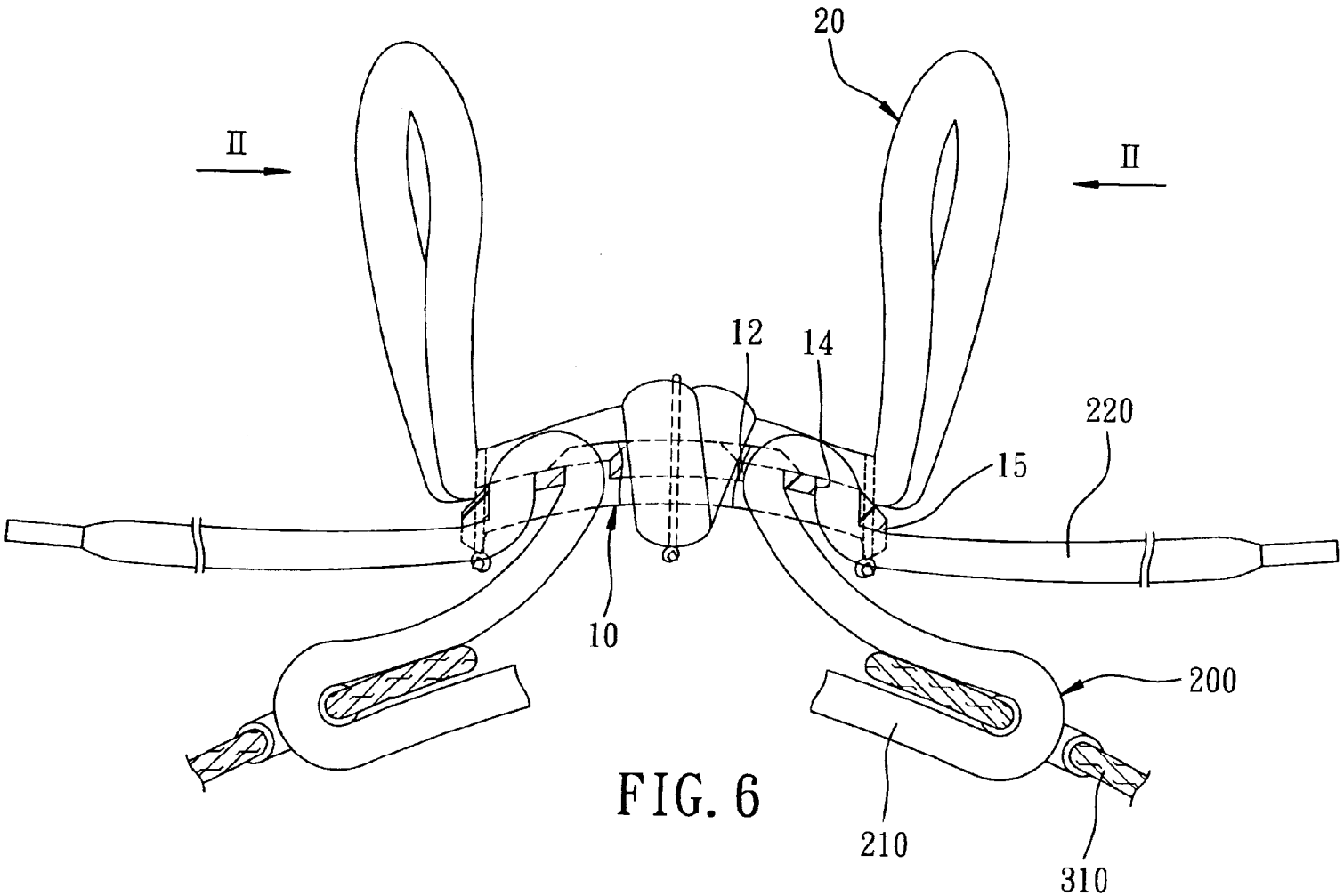
FIG. 6 is a view similar to FIG. 3, illustrating a loosening operation of the shoe.

As shown in FIG. 6, to loosen the shoe body 300, a manual pulling force is applied on the fastener body 10 through the pull unit 20 to move the fastener body 10 upwardly away from the eyelet tabs 310. This releases the distal lace segments 220 from being clamped against the fastener body 10 so as to permit sliding movement of the distal lace segments 220 as indicated by the arrows (II) in FIG. 6 for loosening the shoe body 300 accordingly.

Figure 7:
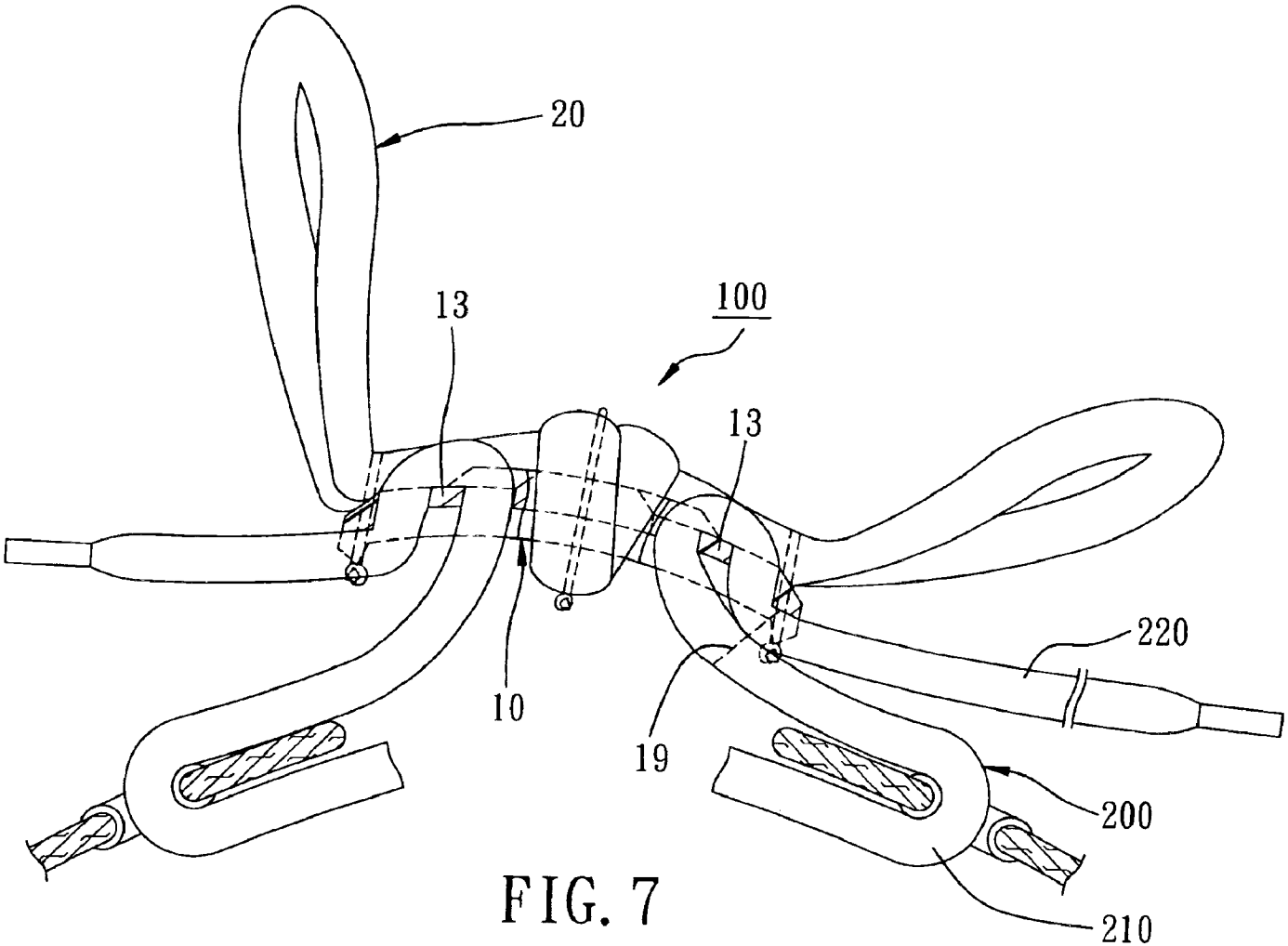
FIG. 7 is a schematic assembled sectional view of the second preferred embodiment of a shoelace fastener according to the present invention.

FIG. 7 illustrates the second preferred embodiment of a shoelace fastener 100 according to this invention, which is a modification of the previous embodiment. Unlike the first preferred embodiment, the shoelace fastener 100 of this embodiment further includes a fixing unit 19 in the form of a stitch seam that is provided on one of the distal lace segments 220 for fixing the latter on the respective one of the anchor portions 13. Tightening of the shoe body is accomplished by pulling at the other of the distal lace segments 220. Moreover, when an upward pulling force is exerted on the pull unit 20, only the other of the distal lace segments 220 will be permitted to slide for loosening the shoe body.

It should be noted that, while the fastener body 10 is exemplified herein as an injection molded plastic plate body, it is apparent to those skilled in the art that the fastener body 10 may implemented using a punched plate body.

In sum, the shoelace fastener 100 of the present invention is easy to operate in view of the presence of the pull unit 20. Moreover, since there is no need to hold the fastener body 10 when it is desired to loosen a shoe, the size of the fastener body 10 can be designed to be smaller as compared to the prior art so as not to result in an adverse affect on the appearance of the shoe.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A shoelace fastener for a shoe, the shoe including a shoe body with a pair of eyelet tabs, and a shoelace stung on the eyelet tabs and having a pair of distal lace segments, said shoelace fastener comprising:

a substantially rigid fastener body formed with a pair of lace exit holes that are spaced apart from each other in a first direction, a pair of lace entry holes that are disposed between said lace exit holes and that are spaced apart from each other in the first direction, and a pair of anchor portions, each of which is disposed between a respective adjacent pair of said lace entry and exit holes and extends in a second direction transverse to the first directions; and a flexible pull unit secured on said fastener body;

whereby each of the distal lace segments is extendable through a respective one of said lace entry holes, over a respective one of said anchor portions, and into a respective one of said lace exit holes;

whereby tension applied by the eyelet tabs upon the shoelace forces the distal lace segments against said fastener body for maintaining a tightened state of the shoe; and whereby a manual pulling force applied on said fastener body through said pull unit permits sliding movement of at least one of the distal lace segments for loosening the shoe accordingly; and whereby said fastener body has top and bottom sides, said lace entry and exit holes being formed through said top and bottom sides of said fastener body, said fastener body further having a mounting portion between said lace entry holes, said pull unit being secured to said top side of said fastener body at said mounting portion.

2. The shoelace fastener as claimed in claim 1, wherein said mounting portion of said fastener body is formed with a string hole that extends through said top and bottom sides of said fastener body, said shoelace fastener further comprising a connecting string disposed in said string hole, said connecting string having one end connected to said pull unit and an opposite end anchored to said bottom side of said fastener body.

3. The shoelace fastener as claimed in claim 2, further comprising a retaining band connected to said pull unit and disposed around said fastener body at said mounting portion.

4. The shoelace fastener as claimed in claim 1, wherein said pull unit has two loop portions that cooperate with the distal lace segments to form a double-bow configuration.

5. The shoelace fastener as claimed in claim 1, wherein said pull unit is made of the same material as the shoelace.

6. The shoelace fastener as claimed in claim 1, wherein said fastener body has lateral end portions opposite to each other in the fist direction, each of said lateral end portions being formed with a lace notch that extends from said bottom side of said fastener body and that is in spatial communication with a respective one of said lace exit holes.

7. The shoelace fastener as claimed in claim 6, wherein said fastener body is further formed with a string hole in one of said lateral end portions, said shoelace fastener further comprising a connecting string disposed in said string hole and having one end connected to said pull unit and an opposite end anchored on said fastener body.

8. The shoelace fastener as claimed in claim 1, wherein said fastener body is an integrally formed plate body made from plastic.

9. The shoelace fastener as claimed in claim 1, further comprising a fixing unit adapted for fixing one of the distal lace segments on the respective one of said anchor portions.

* * * * *